US007594803B2

(12) United States Patent
Theodore, Jr.

(10) Patent No.: US 7,594,803 B2
(45) Date of Patent: Sep. 29, 2009

(54) ORBIT CONTROL DEVICE FOR A SCROLL COMPRESSOR

(75) Inventor: Michael Gregory Theodore, Jr., Plymouth, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 74 days.

(21) Appl. No.: 11/782,952

(22) Filed: Jul. 25, 2007

(65) Prior Publication Data

US 2009/0028736 A1 Jan. 29, 2009

(51) Int. Cl.

| | |
|---|---|
| ***F04C 18/04*** | (2006.01) |
| ***F04C 15/00*** | (2006.01) |
| ***F04C 29/02*** | (2006.01) |
| ***F01C 21/04*** | (2006.01) |

(52) U.S. Cl. ..... 418/55.3; 418/55.1; 418/55.2; 418/55.6; 418/178; 418/179

(58) Field of Classification Search ..... 418/55.1, 418/55.2, 55.3, 55.6, 178, 179
See application file for complete search history.

(56) References Cited

U.S. PATENT DOCUMENTS

| | | | | |
|---|---|---|---|---|
| 4,259,043 | A | | 3/1981 | Hidden et al. |
| 4,325,683 | A | | 4/1982 | Miyazawa |
| 4,415,318 | A | | 11/1983 | Butterworth et al. |
| 4,585,402 | A | | 4/1986 | Morishita et al. |
| 4,589,828 | A | * | 5/1986 | Sato et al. ..... 418/55.3 |
| 4,609,334 | A | | 9/1986 | Muir et al. |
| 4,696,630 | A | | 9/1987 | Sakata et al. |
| 4,715,733 | A | | 12/1987 | Rood |
| 4,731,000 | A | | 3/1988 | Haag |
| 4,810,176 | A | | 3/1989 | Suefuji et al. |
| 5,094,205 | A | | 3/1992 | Billheimer |
| 5,123,818 | A | | 6/1992 | Gormley et al. |
| 5,147,192 | A | | 9/1992 | Suzuki et al. |
| 5,154,592 | A | | 10/1992 | Ohtani et al. |
| 5,165,878 | A | | 11/1992 | Inagaki et al. |
| 5,342,184 | A | | 8/1994 | Comparin et al. |
| 5,346,376 | A | | 9/1994 | Bookbinder et al. |
| 5,366,359 | A | | 11/1994 | Bookbinder et al. |
| 5,456,584 | A | | 10/1995 | Isomura et al. |
| 5,458,472 | A | | 10/1995 | Kobayashi et al. |
| 5,470,213 | A | * | 11/1995 | Iguchi et al. ..... 418/55.2 |
| 5,478,223 | A | | 12/1995 | Yamamoto et al. |
| 5,520,524 | A | | 5/1996 | Takemoto et al. |
| 5,542,829 | A | | 8/1996 | Inagaki et al. |

(Continued)

FOREIGN PATENT DOCUMENTS

| | | |
|---|---|---|
| EP | 0 016 532 A1 | 10/1980 |

(Continued)

*Primary Examiner*—Thomas E Denion
*Assistant Examiner*—Mary A Davis
(74) *Attorney, Agent, or Firm*—Fraser Clemens Martin & Miller LLC; J. Douglas Miller

(57) ABSTRACT

An orbit control device for a scroll compressor is disclosed including at least one pin disposed in an orbit scroll, a support plate having at least one support hole formed therein, and a guide plate having at least one guide hole formed therein. Contact of an outer surface of the pin with an inner surface of the guide hole militates against a deviation by the orbit scroll from a desired trajectory.

20 Claims, 3 Drawing Sheets

U.S. PATENT DOCUMENTS 5,645,408 A * 7/1997 Fujio et al. ..... 418/55.6
5,807,089 A 9/1998 Tsumagari et al.
5,842,844 A 12/1998 Oki et al.
5,915,933 A 6/1999 Iizuka et al.
6,113,371 A 9/2000 Williams et al.
6,123,530 A 9/2000 Nakazawa et al.
6,186,754 B1 2/2001 Sakai et al.
6,190,147 B1 2/2001 Kimbara et al.
6,231,325 B1 5/2001 Kitano et al.
6,264,444 B1 7/2001 Nakane et al.
6,287,096 B1 9/2001 Nakane et al.
6,302,664 B1 10/2001 Kazakis et al.
6,309,196 B1 10/2001 Jones et al.
6,457,959 B2 10/2002 Nakane et al.
6,616,430 B2 9/2003 Mori et al.
6,666,669 B2 12/2003 Suss
6,712,589 B2 3/2004 Mori et al.
2002/0009379 A1 1/2002 Nakane et al.
2004/0191082 A1 * 9/2004 Gennami et al. ..... 417/310
2005/0220651 A1 * 10/2005 Tsukamoto et al. ..... 418/55.3
2006/0099096 A1 5/2006 Shaffer et al.

FOREIGN PATENT DOCUMENTS

EP 0 016 532 B1 10/1980
EP 0 010 930 B1 9/1983
EP 0 652 371 B1 5/1995
EP 0 756 086 A1 1/1997
EP 0 756 086 B1 1/1997
EP 0 872 640 B1 10/1998

* cited by examiner

ORBIT CONTROL DEVICE FOR A SCROLL COMPRESSOR

FIELD OF THE INVENTION

The invention relates to a scroll compressor and more particularly to an orbit control device for a scroll compressor including a support plate having at least one support hole, a guide plate having at least one guide hole, and at least one pin, wherein an outer surface of the pin travels adjacent an inner surface of the guide hole to militate against a deviation from a desired path of travel by the orbit scroll.

BACKGROUND OF THE INVENTION

Presently, there are scroll compressors which use a pair of spiral involutes formed on a pair of plates. One plate is typically fixed, and the other plate travels in orbiting pattern in respect of the fixed plate, thereby gradually compressing a fluid. The fluid is eventually discharged through a discharge port. Known scroll compressors rely on various orbit control structures which enable the orbiting scroll to maintain a desired trajectory for efficient operation. The known orbit control structures include a ball coupling ring, an eccentric motion bearing, an Oldham coupling, a pin and barrel, and a pin and ring, for example.

One such control structure is disclosed in U.S. Pat. No. 5,147,192, hereby incorporated herein by reference in its entirety. The '192 patent describes a scroll compressor including an orbit scroll having a first forming plate affixed thereto and a fixed plate having a second forming plate affixed thereto. The forming plates face one another and include a plurality of circular recesses formed therein on each of the facing surfaces. The recesses are formed in an annular pattern. A coupling lug is disposed between each facing pair of recesses. The recesses can be formed in the fixed plate and the orbit scroll.

U.S. Pat. No. 5,456,584, hereby incorporated herein by reference in its entirety, discloses an anti-rotation mechanism for a scroll compressor. The mechanism includes a fixed ring attached to a race and a rear housing. A moveable ring is affixed to a pressure receiving wall of an orbit scroll. Both the fixed ring and the moveable ring include a plurality of circular holes formed therein. The holes are adapted to receive one of a plurality of cylindrical pins therein. Alternatively, the mechanism includes a plurality of pins, each having two ends protruding from a moveable ring. The pins cooperate with a plurality of holes formed in a moveable plate and a fixed pressure-receiving wall.

In U.S. Pat. No. 6,264,444, hereby incorporated herein by reference in its entirety, a scroll compressor is disclosed which includes an orbital rotating mechanism disposed at an end of an orbit scroll. The mechanism includes a plurality of guide holes formed in a front housing and a pressure receiving plate. The plate is disposed between the orbit scroll and the front housing. A plurality of pins is attached to the back surface of the orbit scroll. The pins are adapted to be received in the guide holes. An outer peripheral surface of each of the pins makes sliding contact with an inner peripheral surface of each of the guide holes.

Although the aforementioned structures operate effectively, the structures require numerous parts. Additionally, the structures are difficult to manufacture, costly, heavy, and lack durability.

It would be desirable to produce an orbit control device for a scroll compressor wherein a cost, complexity, and weight thereof are minimized and a durability thereof is maximized.

SUMMARY OF THE INVENTION

In concordance and agreement with the present invention, an orbit control device for a scroll compressor wherein a cost, complexity, and weight thereof are minimized and a durability thereof is maximized, has surprisingly been discovered.

In one embodiment, an orbit control device for the scroll compressor comprises at least one pin adapted to be joined with an orbit scroll; a support plate including at least one support hole formed therein; and a guide plate disposed adjacent the support plate, the guide plate including at least one guide hole formed therein substantially aligned with the support hole formed in the support plate and having a diameter larger than a diameter of the pin, the pin received in the support hole of the support plate and the guide hole of the guide plate, wherein an inner surface forming the guide hole of the guide plate guides a path of movement of the pin In another embodiment, a scroll assembly for the scroll compressor comprises a fixed scroll having a spiral involute disposed thereon; an orbit scroll having at least one aperture formed therein and a spiral involute disposed thereon adapted to cooperate with the spiral involute of the fixed scroll; and an orbit control device. The orbit control device further comprises a support plate disposed adjacent the orbit scroll, the support plate including at least one support hole formed therein; a guide plate disposed adjacent the support plate, the guide plate including a guide hole formed therein substantially aligned with the support hole of the support plate and having a diameter larger than a diameter of the support hole of the support plate; and at least one pin disposed in the aperture of the orbit scroll and adapted to be received in the support hole of the support plate and the guide hole of the guide plate, wherein an inner surface forming the guide hole of the guide plate abuts the pin to guide a path of movement of the orbit scroll.

In another embodiment, the scroll compressor comprises a housing forming a hollow interior; and a scroll assembly disposed in the hollow interior of the housing, the scroll assembly including a fixed scroll having a spiral involute, an orbit scroll having an annular array of apertures formed therein and a spiral involute adapted to cooperate with the involute of the fixed scroll to compress a fluid, and an orbit control device. The orbit control device further comprises a support plate disposed adjacent the orbit scroll and having an annular array of support holes formed therein; a guide plate having an annular array of guide holes formed therein, wherein the pins travel around an inner surface of the guide hole at least one spaced apart pin disposed in the back of the orbit scroll; and a plurality of pins disposed in the apertures of the orbit scroll, the pins adapted to be received in the support holes of the support plate and the guide holes of the guide plate, wherein an inner surface forming the guide holes of the guide plate abut the pins to guide a path of movement of the orbit scroll.

BRIEF DESCRIPTION OF THE DRAWINGS

The above and other objects and advantages of the invention will become readily apparent to those skilled in the art from reading the following detailed description of the invention when considered in the light of the accompanying drawings, in which.

DETAILED DESCRIPTION OF THE PREFERRED EMBODIMENTS OF THE INVENTION

The following detailed description and appended drawings describe and illustrate various exemplary embodiments of the present invention. The description and drawings serve to enable one skilled in the art to make and use the invention, and are not intended to limit the scope of the invention in any manner. It is understood that materials other than those described can be used without departing from the scope and spirit of the invention.

Figure 1:
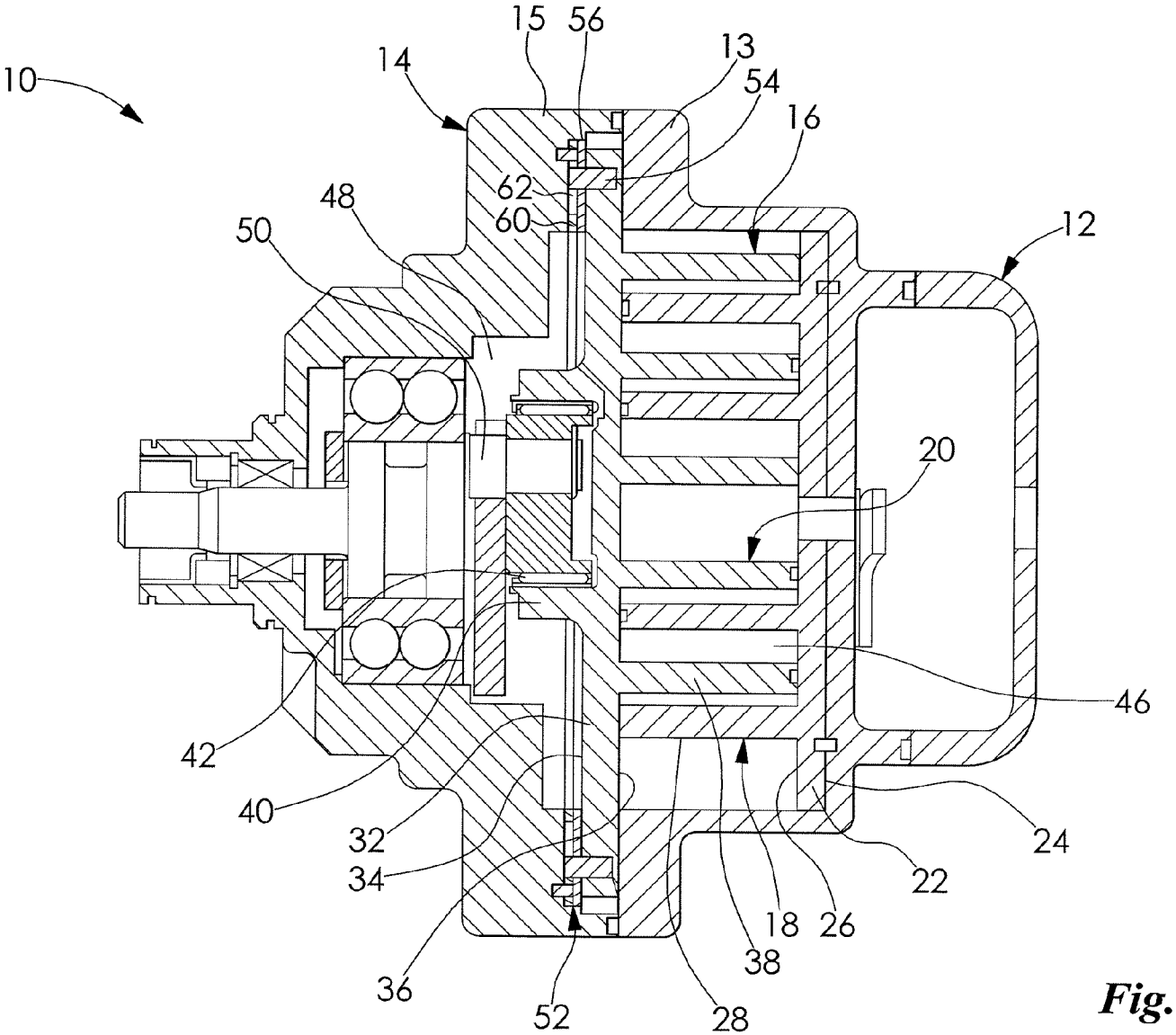
FIG. 1 is a cross-sectional view of a scroll compressor including an orbit control device according to an embodiment of the invention.

FIG. 1 shows a scroll compressor 10 according to an embodiment of the invention. The scroll compressor 10 includes a housing assembly having a first housing shell 12, a second housing shell 14, and a scroll assembly 16. The first housing shell 12 and the second housing shell 14 cooperate to form a hollow chamber therebetween. The first housing shell 12 can be produced from any conventional material such as aluminum, for example. Although the first housing shell 12 has a substantially circular cross-sectional shape, other cross-sectional shapes can be used as desired. The first housing shell 12 has a radially outwardly extending peripheral flange 13 formed thereon.

The second housing shell 14 can be produced from any conventional material such as aluminum, for example. Although the second housing shell 14 has a substantially circular cross-sectional shape, other cross-sectional shapes can be used as desired. A radially outwardly extending peripheral flange 15 is formed on the second housing shell 14. The flange 15 is adapted to cooperate with the flange 13 of the first housing shell 12 to form a substantially fluid tight seal. The flange 13 of the first housing shell 12 and the flange 15 of the second housing shell 14 can be joined using bolts, screws, clips, and the like, for example.

The scroll assembly 16 includes a fixed scroll 18, an orbit scroll 20, and an orbit control device 52. The fixed scroll 18 has a substantially circular cross-sectional shape, although other cross-sectional shapes can be used as desired. The fixed scroll 18 includes a base plate 22 having a first face 24 and a second face 26. A spiral involute 28 extends laterally outwardly from the second face 26 of the base plate 22. The base plate 22 is secured to the first housing shell 12 using any conventional means of attachment such as pins, screws, bolts, and the like, for example. In the embodiment shown, the fixed scroll 18 is formed from aluminum. However, it is understood that other conventional materials can be used if desired.

The orbit scroll 20 has a substantially circular cross-sectional shape. It is understood that other cross-sectional shapes can be used as desired. The orbit scroll 20 includes a base plate 32 having a first face 34, a second face 36, and a hub 40 adapted to receive a bearing 42 therein. The second face 36 includes a spiral involute 38 laterally outwardly extending therefrom. The spiral involute 38 of the orbit scroll 20 is received in and engages the spiral involute 28 of the fixed scroll 18 to define a plurality of compression chambers 46 therebetween. It is understood that wraps of the involutes 28, 38 can be shifted, maximized, or minimized, as desired. The second shell housing 14 and the end plate 32 of the orbit scroll 20 define a crank chamber 48 therebetween. A crank mechanism 50 is disposed in the crank chamber 50. In the embodiment shown, the orbit scroll 20 is formed from aluminum. However, it is understood that other conventional materials can be used if desired.

Figure 2:
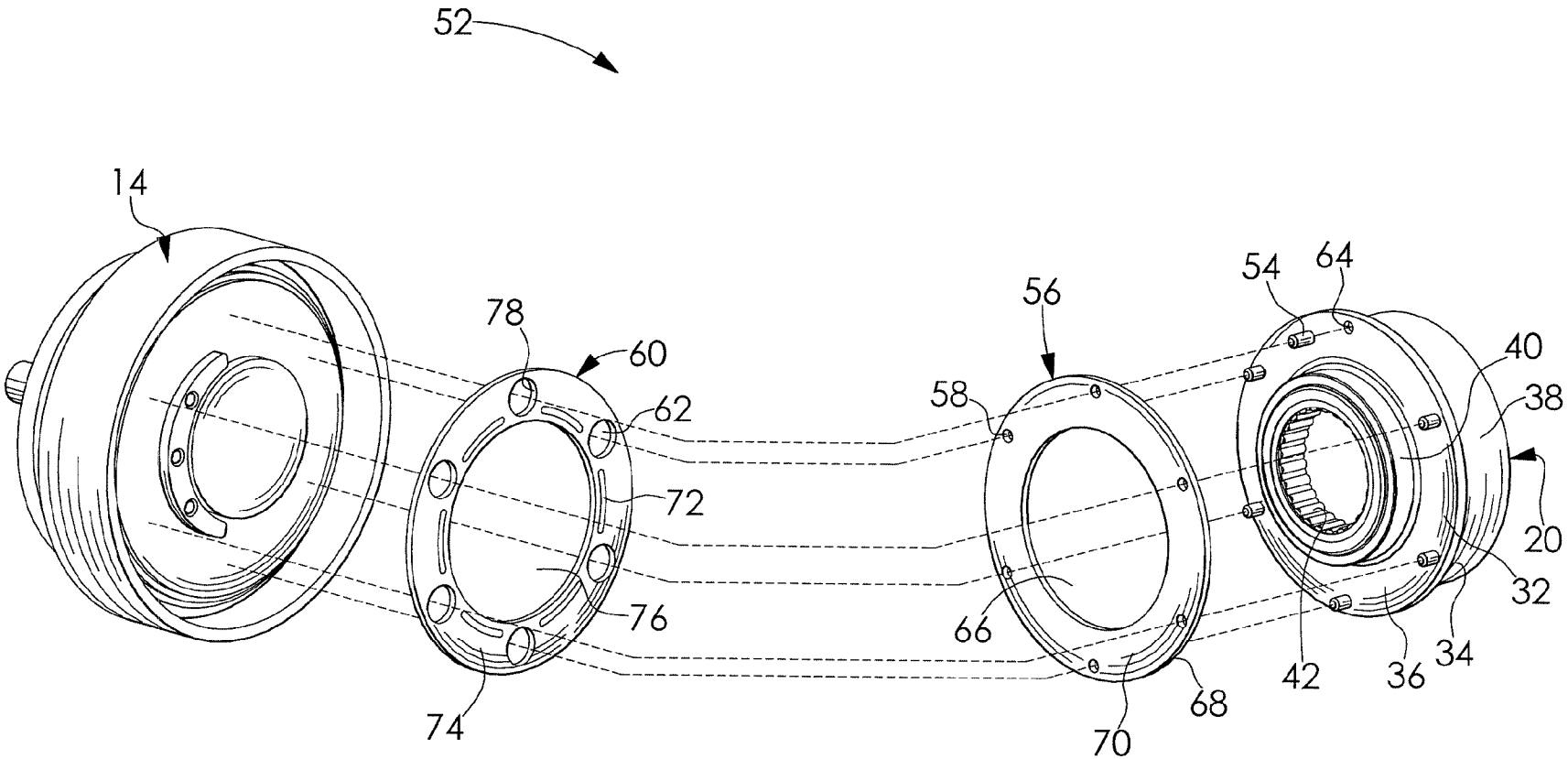
FIG. 2 is an exploded perspective view of the orbit control device for the scroll compressor illustrated in FIG. 1.

FIG. 2 illustrates the orbit control device 52. The orbit control device 52 includes the orbit scroll 20, a support plate 56, a guide plate 60, and the second shell housing 14. An annular array of pins 54 is press fit into apertures 64 formed in the second face 36 of the orbit scroll 20 and extend laterally outwardly therefrom, although other attachment methods and structures can be used as desired. As shown, the pins 54 have a substantially circular cross-sectional shape. It is understood that the pins 54 can have other cross-sectional shapes as desired. The pins 54 can be produced from any conventional material such as rolled steel, for example.

The support plate 56 is substantially disk shaped with a central aperture 66 formed therein. Any conventional material can be used to produce the support plate 56 such as steel, copper alloys, and cast iron, for example. An annular array of support holes 58 is formed in the support plate 60. The holes 58 are substantially aligned with the pins 54 and permit the pins 54 to extend therethrough. In the embodiment shown, a diameter of the support holes 58 is slightly larger than a diameter of the pins 54. Although the support plate 56 shown is held in place by an interference fit between the pins 54 and the support holes 58, the support plate 56 may be affixed to the orbit scroll 20 by any conventional means, such as pins, screws, and the like, for example. The support plate 56 includes a first face 68 and a second face 70. The first face 68 is adapted to seat adjacent the second face 36 of the orbit scroll 20. The second face 70 can include an applied coating such as polytetrafluoroethylene (PFTE) and molybdenum disulfide ($MoS_2$), for example, or a surface modification adapted to minimize friction, if desired.

The guide plate 60 is substantially disk shaped and includes a central aperture 76 formed therein. An annular array of guide holes 62 is formed in the guide plate 60. In the embodiment shown, a diameter of each of the guide holes 62 is larger than a diameter of each of the support holes 58 and a diameter of each of the pins 54. However, other diameters can be used as desired. The pins 54 extend through the guide holes 62. The number of pins 54, and the corresponding number of the support holes 58 and the guide holes 62, can be increased or decreased depending upon a load on the scroll compressor 10, material properties of the materials used to produce components of the scroll compressor 10, or other design considerations. A cam surface 78 surrounding the guide holes 62 guide a path of the orbit scroll 20.

A first face 74 of the guide plate 60 may include a plurality of spaced apart indentations 72 formed therein. In the embodiment shown, an annular array of indentations 72 is formed, each indentation 72 having an oblong shape. However, it is understood that more or fewer indentations, indentations having different shapes, and indentations formed in different patterns can be used without departing from the scope and spirit of the invention. It is further understood that the indentations 72 can be formed elsewhere on the guide plate 60, as desired. The indentations 72 are formed to collect and disperse a lubricant, such as oil, for example, over respective mating faces 70, 74 of the support plate 56 and the guide plate 60.

Figure 3:
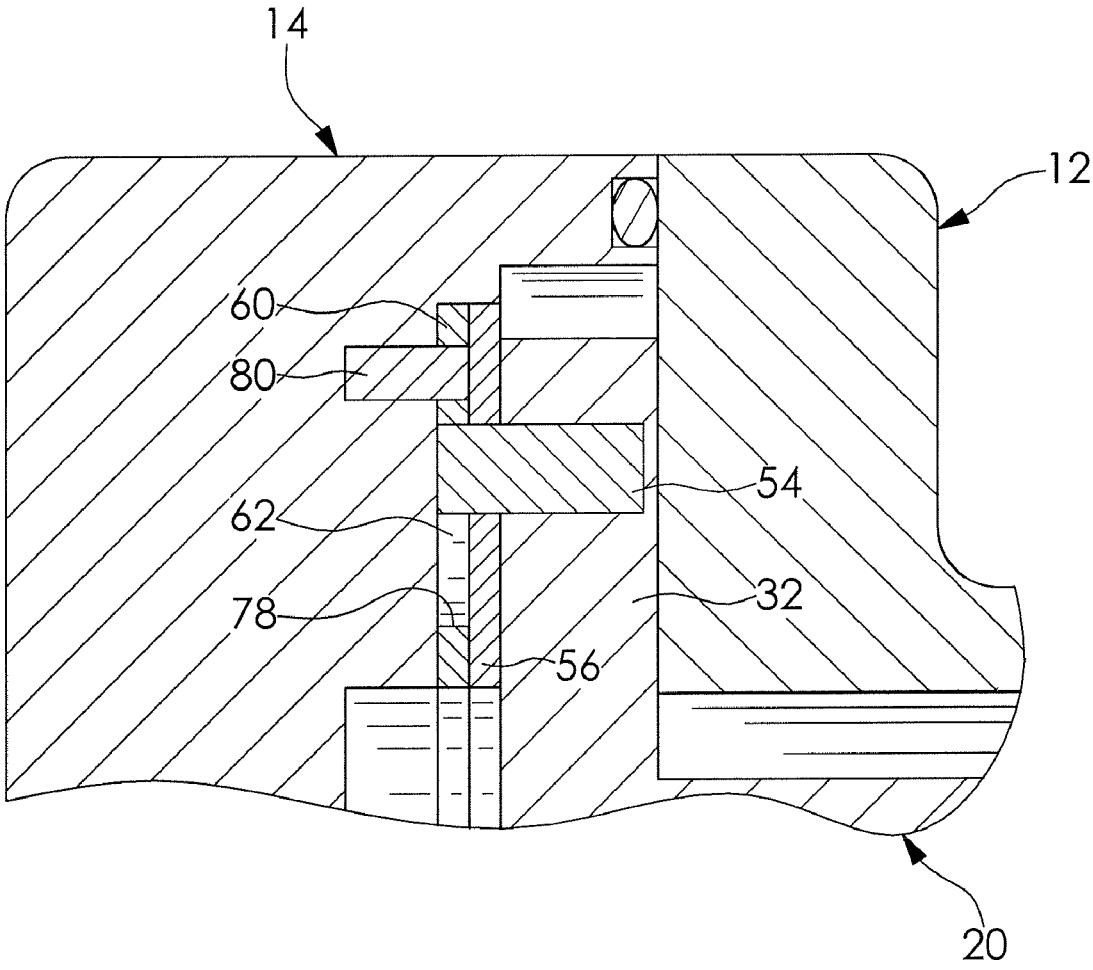
FIG. 3 is a cross-sectional view of the orbit control device for the scroll compressor illustrated in FIGS. 1 and 2.

The guide plate 60 is secured to the second housing shell 14 using pins 80 as shown in FIG. 3. It is understood that other means of attachment can be used such as screws, and the like, for example. The guide plate 60 can be produced from any conventional material known in the art such as steel, a copper alloy, and cast iron, for example. The guide plate 60 may be produced from a harder material than the support plate 56, if desired, in order to control wear patterns and wear characteristics of the plates 56, 60. The guide plate 60 can also include an applied coating such as polytetrafluoroethylene (PFTE)

and molybdenum disulfide ($MoS_2$), for example, or a surface modification, if desired. The second face 70 of the support plate 56 slidably contacts the first face 74 of the guide plate 60.

In operation, the crank mechanism 50 disposed in the crank chamber 48 causes the orbit scroll 20 to revolve in a desired path, as is known in the art. The cam surfaces 78 cooperate with the pins 54 of the orbit scroll 20 to militate against a deviation from the desired path. More specifically, as the orbit scroll 20 revolves, an outer surface of the pins 54 slidably contacts the cam surface 78 of the guide holes 62. Accordingly, the orbit scroll 20 is caused to revolve within limitations provided by the cam surfaces 78. Thus, the desired path of the orbit scroll 20 is controlled by the diameter of the guide holes 62. The support plate 56 militates against undesirable wear of the orbit scroll 20 and the pins 54. Additionally, when the indentations 72 are provided, a lubricant is collected in and dispersed from the indentations 72 to minimize heated generated due to contact between the plates 56, 60 and further militate against undesirable wear.

From the foregoing description, one ordinarily skilled in the art can easily ascertain the essential characteristics of this invention and, without departing from the spirit and scope thereof, can make various changes and modifications to the invention to adapt it to various usages and conditions in accordance with the scope of the appended claims.

What is claimed is:

1. An orbit control device for a scroll compressor comprising:

at least one pin adapted to be joined with an orbit scroll;

a support plate seated adjacent the orbit scroll, the support plate including at least one support hole formed therein; and a guide plate disposed between the support plate and a housing, the guide plate including at least one guide hole formed therein substantially aligned with the support hole formed in the support plate and having a diameter larger than a diameter of the pin, the pin received in the support hole of the support plate and the guide hole of the guide plate, wherein only an inner surface forming the guide hole of the guide plate guides a path of movement of the pin.

2. The orbit control device according to claim 1, wherein at least one of the support plate and the guide plate includes at least one indentation formed therein to collect and disperse a lubricant.

3. The orbit control device according to claim 1, wherein the support plate is produced from at least one of a copper alloy, steel, and cast iron.

4. The orbit control device according to claim 1, wherein the at least one of the support plate and the guide plate includes a surface modification adapted to minimize friction.

5. The orbit control device according to claim 1, wherein at least one of the support plate and the guide plate is at least partially coated with at least one of polytetrafluoroethylene and molybdenum disulfide.

6. The orbit control device according to claim 1, wherein the guide plate is produced from at least one of a copper alloy, steel, and cast iron.

7. A scroll assembly comprising:

a fixed scroll having a spiral involute disposed thereon;

an orbit scroll having a spiral involute disposed thereon adapted to cooperate with the spiral involute of the fixed scroll to compress a fluid; and an orbit control device further comprising:

a support plate seated adjacent the orbit scroll, the support plate including at least one support hole formed therein;

a guide plate disposed between the support plate and a housing, the guide plate including a guide hole formed therein substantially aligned with the support hole of the support plate and having a diameter larger than a diameter of the support hole of the support plate; and at least one pin adapted to be joined with the orbit scroll and received in the support hole of the support plate and the guide hole of the guide plate, wherein only an inner surface forming the guide hole of the guide plate abuts the pin to guide a path of movement of the orbit scroll.

8. The scroll assembly according to claim 7, wherein at least one of the support plate and the guide plate includes at least one indentation formed therein to collect and disperse a lubricant.

9. The scroll assembly according to claim 7, wherein the support plate is produced from at least one of a copper alloy, steel, and cast iron.

10. The scroll assembly according to claim 7, wherein at least one of the support plate and the guide plate is at least partially coated with at least one of polytetrafluoroethylene and molybdenum disulfide.

11. The scroll assembly according to claim 7, wherein the guide plate is produced from at least one of a copper alloy, steel, and cast iron.

12. A scroll compressor comprising:

a housing forming a hollow interior; and a scroll assembly disposed in the hollow interior of the housing, the scroll assembly including a fixed scroll having a spiral involute, an orbit scroll having an annular array of apertures formed therein and a spiral involute adapted to cooperate with the involute of the fixed scroll to compress a fluid, and an orbit control device, the orbit control device further comprising:

a support plate seated adjacent the orbit scroll and having an annular array of support holes formed therein;

a guide plate disposed between the support plate and the housing, the guide plate having an annular array of guide holes formed therein, and a plurality of pins disposed in the apertures of the orbit scroll, the plurality of pins adapted to be joined with the orbit scroll and received in the support holes of the support plate and the guide holes of the guide plate, wherein only an inner surface forming the guide holes of the guide plate abut the plurality of pins to guide a path of movement of the orbit scroll.

13. The compressor according to claim 12, wherein the plurality of pins is press fit into the apertures formed in the orbit scroll.

14. The compressor according to claim 12, wherein the guide plate is in sliding contact with the support plate.

15. The compressor according to claim 12, wherein at least one of the support plate and the guide plate includes at least one indentation formed therein to collect and disperse a lubricant.

16. The compressor according to claim 12, wherein the support plate is produced from at least one of a copper alloy, steel, and cast iron.

17. The compressor according to claim 12, wherein at least one of the support plate and the guide plate includes a surface modification adapted to minimize friction.

18. The compressor according to claim 17, wherein the surface modification is an applied coating including at least one of polytetrafluoroethylene and molybdenum disulfide.

19. The compressor according to claim 12, wherein a diameter of the guide hole is larger than a diameter of one of the plurality of pins.

20. The compressor according to claim 12, wherein the guide plate is produced from at least one of a copper alloy, steel, and cast iron.

* * * * *